US005795274A

United States Patent [19]

Kasbohm

[11] Patent Number: 5,795,274

[45] Date of Patent: Aug. 18, 1998

[54] PORTABLE EXERCISE PULLEY BELT APPARATUS

[75] Inventor: Michael J. Kasbohm, Minnetonka, Minn.

[73] Assignee: Lawrence C. Chasin, Morris Plains, N.J.

[21] Appl. No.: 647,034

[22] Filed: May 9, 1996

[51] Int. Cl.[6] ..... A63B 21/02; A63B 21/015

[52] U.S. Cl. ..... 482/115; 482/120; 482/124; 482/126

[58] Field of Search ..... 482/114, 115, 482/116, 117, 118, 120, 121, 122, 124

[56] References Cited

U.S. PATENT DOCUMENTS

| | | | |
|---|---|---|---|
| 4,728,102 | 3/1988 | Pauls | 482/118 |
| 5,176,377 | 1/1993 | Wilkinson | 482/120 |
| 5,358,461 | 10/1994 | Bailey, Jr. | 482/124 X |

FOREIGN PATENT DOCUMENTS

| | | | |
|---|---|---|---|
| 1333776 | 6/1963 | France | 482/119 |

*Primary Examiner*—Richard J. Apley

*Assistant Examiner*—William LaMarca

*Attorney, Agent, or Firm*—Lawrence C. Chasin

[57] ABSTRACT

An exercise apparatus which isometrically works the upper body muscles while the person is engaged in an aerobic activity such as walking or while the person remains in a standing or sitting stationary position. The exercise apparatus includes a belt member having a first end, a second end, and a body section disposed between the first and second ends. The first and second ends are securable to each other for fastening the belt member around the torso of a person. A pulley housing is mounted to the body section of the belt. A pulley wheel is rotatably mounted within the pulley housing. An adjustable tension mechanism is attached to the pulley housing and the pulley wheel for selectively adjusting an amount of force needed to rotate the pulley wheel within the pulley housing. A pulley cable, having a first handle attached to a first end thereof and a second handle attached to a second end thereof, is arranged on the pulley wheel such that movement of the first handle in a direction away from the pulley wheel moves the second handle toward the pulley wheel and such that movement of the second handle in a direction away from the pulley wheel moves the first handle toward the pulley wheel.

10 Claims, 3 Drawing Sheets

PORTABLE EXERCISE PULLEY BELT APPARATUS

BACKGROUND OF THE INVENTION

The present invention relates to exercise apparatuses, and more particularly, to a portable exercise apparatus for exercising a person's upper body muscles.

Portable exercise apparatuses have been around for many years. However, such apparatuses are generally not intended to be used while the person is engaged in an aerobic activity such as walking. Hand weights and hand grips may be used during aerobic walking activity, but such devices do not work many of the upper body muscles in a full range of motion not do they allow for variable resistances.

SUMMARY OF THE INVENTION

The present invention provides an exercise apparatus which works the upper body muscles by providing self-generated, variable resistance while the person is engaged in an aerobic activity such as walking or while the person remains in a stationary standing or sitting position. The exercise apparatus includes a belt member having a first end, a second end, and a body section disposed between the first and second ends. The first and second ends are securable to each other for fastening the belt member around the waist of a person. A pulley housing is mounted to the body section of the belt. A pulley wheel is rotatably mounted within the pulley housing. An adjustable tension mechanism is attached to the pulley housing and the pulley wheel for selectively adjusting an amount of force needed to rotate the pulley wheel within the pulley housing. A pulley cable, having a first handle is attached to a first end thereof and a second handle attached to a second end thereof, is arranged on the pulley wheel such that movement of the first handle in a direction away from the pulley wheel moves the second handle toward the pulley wheel and such that movement of the second handle in a direction away from the pulley wheel moves the first handle toward the pulley wheel.

DETAILED DESCRIPTION OF THE PREFERRED EMBODIMENTS

Figure 1:
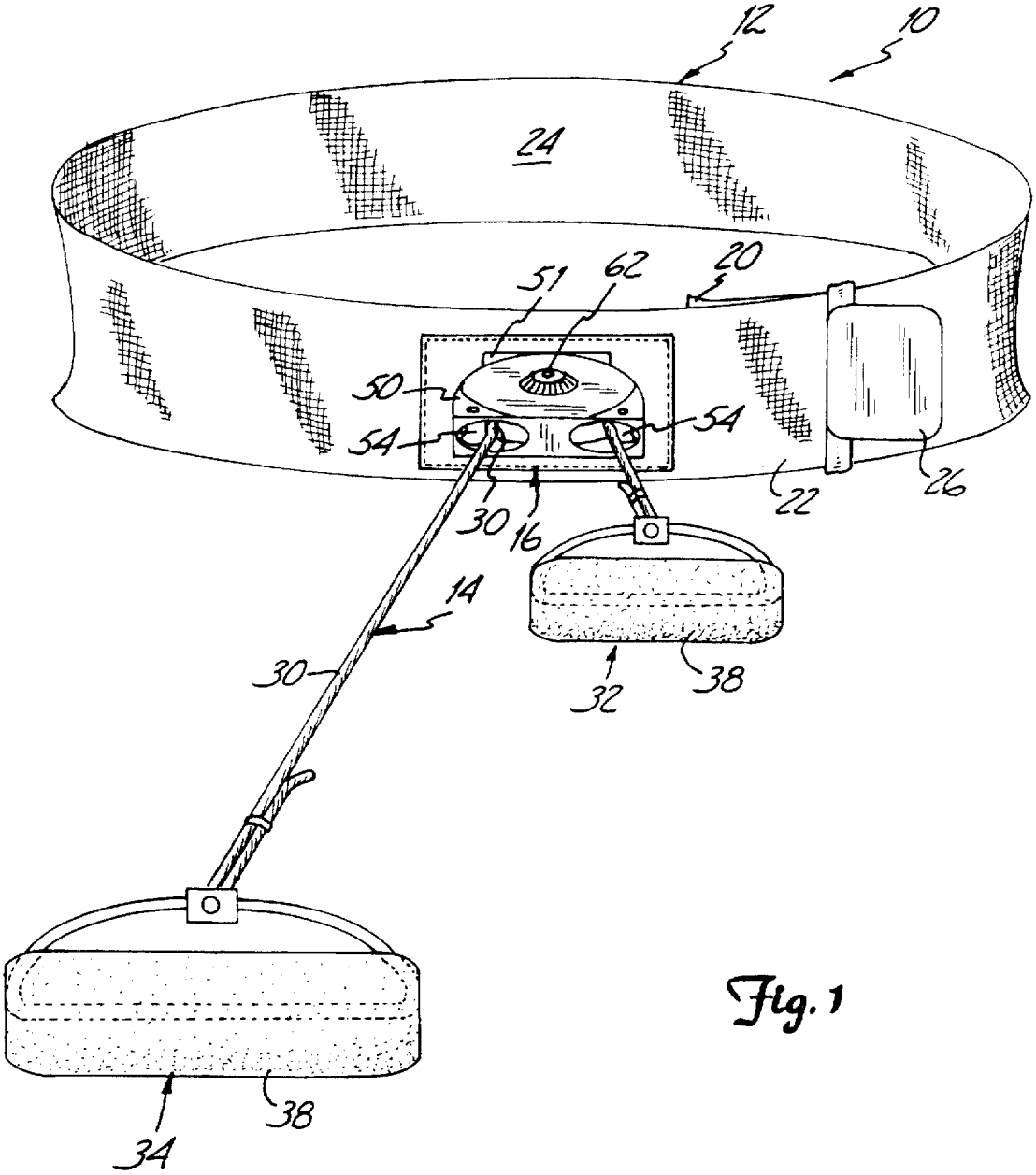
FIG. 1 is a perspective view of the exercise apparatus according to the teachings of the present invention.

The exercise apparatus 10, as shown in FIG. 1, includes a belt member 12, an exercise cable 14, and an pulley arrangement 16. The exercise apparatus 10 is intended to be used while walking or jogging to provide further aerobic activity and to isolate and tone the upper body muscles. The exercise apparatus is also intended to be used by a person who is standing or sitting for the same reasons.

The belt member 12 includes a first end 20, a second end 22, a body section 24 disposed between the first and second ends, and a securement mechanism 26. The securement mechanism 26 secures the first and second ends 20 and 22 to each other for fastening the belt member 12 around the waist of a person. The belt member 12 may also be fastened around the upper torso of the person to work the upper body muscles from a different angle. The particular securement mechanism 26 may be any one of the variety of well known securement devices, including Velcro or a buckle. Alternatively, the first and second ends may simply be hand-tied together.

The exercise cable 14 includes a pulley rope 30, first handle 32 attached to a first end thereof and a second handle 34 attached to a second end thereof. The pulley rope 30 is wound within the pulley arrangement 16, as further explained below, such that the first and second handles 32 and 34 and a portion of the pulley rope 30 extend from the pulley arrangement 16. The first and second handles 32 and 34 each have a hand grip portion 38 and a base portion 40 for securement to the pulley rope 30. The base portion 40 has an opening 41 through which an end of the pulley rope 30 extends, and a locking clip or screw 42 (see FIG. 2) which pinches or otherwise secures the pulley rope 30 to the handles 38. The locking clips 42 thereby permit adjustment of the portion of the pulley rope 30 which extends from the pulley arrangement 16 in order to fit the first and second handles 32 and 34 to the arm length of the person using the exercise apparatus 10. In other words, the position of the first and second handles 32 and 34 along the length of the pulley rope 30 is adjustable to the particular arm length of the person using the exercise apparatus 10 and to the particular exercise being performed.

Figure 2:
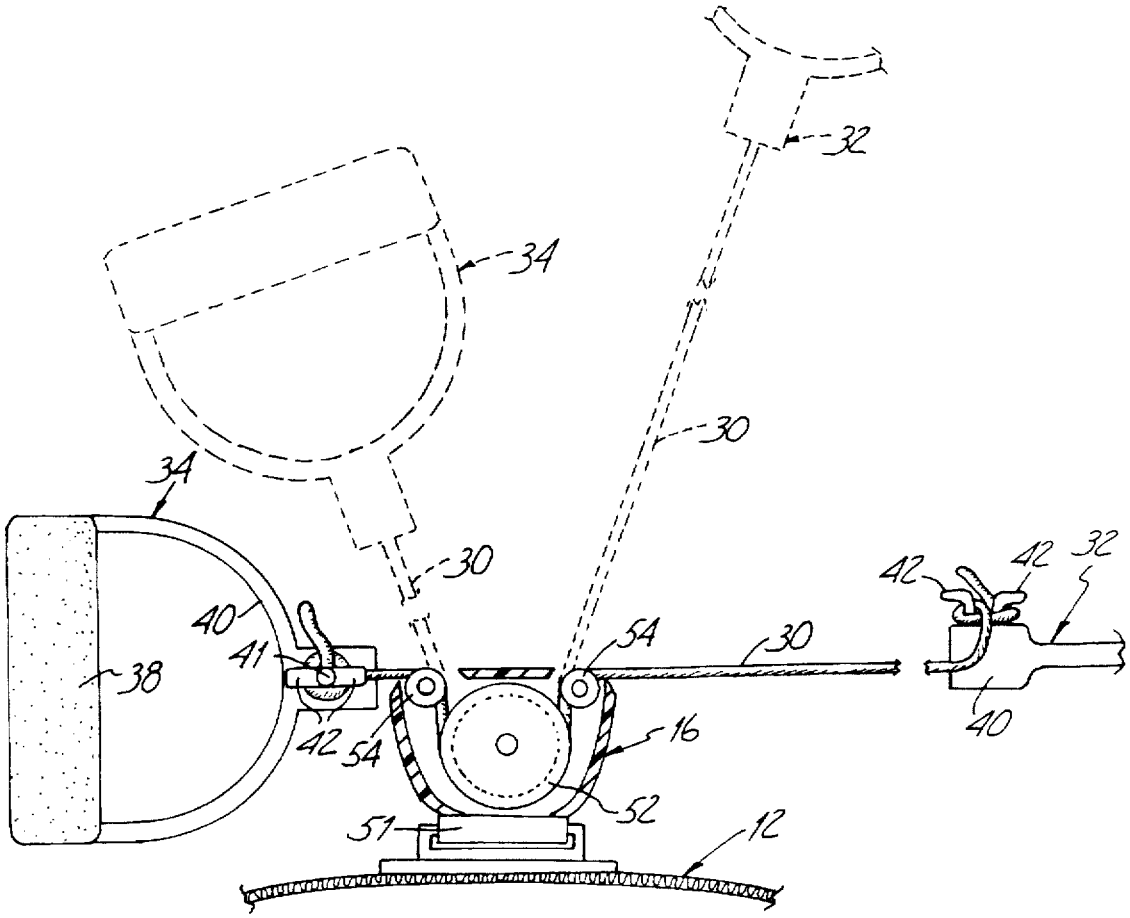
FIG. 2 is a top view of the exercise apparatus according to the teachings of the present invention.
Figure 3:
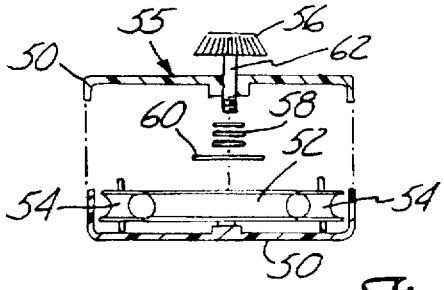
FIG. 3 is a partially exploded elevational view of the pulley housing of the exercise apparatus according to the teachings of the present invention.

The pulley arrangement 16 offers the person using the exercise apparatus the ability to self-generate resistive tension on the pulley rope 30, similar to isometric resistance exercises. Referring to FIGS. 2 and 3, the pulley arrangement 16 includes a pulley housing 50, a pivot hinge 51, a center pulley wheel 52, a pair of guide pulley wheels 54, and a tension control mechanism 55. The pulley housing 50 is pivotally mounted to the body section 24 of the belt member 12 by the pivot hinge 51. The pivot hinge 51 permits only upward and downward pivoting of the pulley housing 50 to permit the reciprocal movement of the pulley rope 30 in a variety of vertical angles. The pulley housing 50 does not allow side-to-side pivoting in the preferred embodiment as such motion hampers the reciprocal motion of the pulley rope 30 into and out of the pulley housing 50 during certain exercises.

The center pulley wheel 52 is rotatably mounted within the pulley housing 50 on a pin 62. The pulley rope 30 is wound around the center pulley wheel 52 so that the first and second ends extend from the pulley housing 50 for use in exercising. The pulley rope 30 operates with the center pulley wheel 52 such that movement of the first handle 32 in a direction away from the pulley wheel 52 moves the second handle 34 toward the pulley wheel 52 and such that movement of the second handle 34 in a direction away from the pulley wheel 52 moves the first handle 32 toward the pulley wheel 52. The guide pulley wheels 54 are arranged in the pulley housing 50 adjacent the main opening of the pulley housing 50, adjacent to the center pulley wheel 52. More specifically, a first of the pair of guide pulley wheels 54 is rotatably mounted within the pulley housing 52 so that a first portion of the pulley rope 30 runs between and engages both the center pulley wheel 52 and the first guide pulley wheel. A second of the pair of guide pulley wheels 54 is rotatably mounted within the pulley housing 50 opposite the first guide wheel so that a second portion of the pulley rope 30 runs between and engages both the center pulley wheel 52 and the second guide pulley wheel. The guide pulley wheels 54 prevent the pulley rope 30 from catching or rubbing against the pulley housing 50 when the handles 32 and 34 are pulled away from the pulley housing 50 at an angle during use of the exercise apparatus.

The tension control mechanism 55 is intended to further increase the resistance the person experiences while using the exercise apparatus 10. The tension control mechanism 55 includes an adjustable tension knob 56, a tension spring 58, and a friction pad 60. The friction pad 60 rides adjacent and in adjustable friction contact with the center pulley wheel 52. The tension spring 58 is positioned around the pin 62 between the friction pad 60 and the tension knob 56. The tension knob 56 is mounted on the pin 62 so that rotation thereof selectively increases or decreases the tension force the spring 58 exerts against the friction pad 60, thereby providing a selective adjustment of the amount of force needed to rotate the pulley wheel 52 within the pulley housing 50.

Figures 4A, 4B:
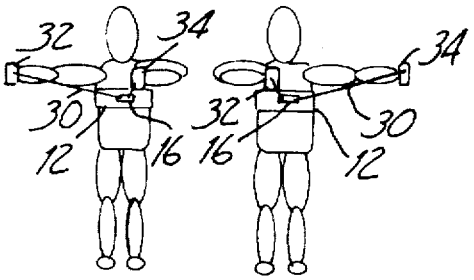
FIGS. 4A–4I are schematic drawings showing a variety of exercises which use the exercise apparatus according according to the teachings of the present invention.

FIGS. 4A–4H schematically illustrate a few of the exercises which may be used to tone and strengthen the upper body muscles. In FIGS. 4A and 4B the belt member 12 is positioned under the persons arms and the handles 32 and 34 are alternately pulled outward to provide an isometric tension force. More specifically, the handles 32 and 34 are alternately pulled from the center of the person's body to a position where the person's arms are at the side of the person's body and substantially perpendicular to the length of the body. In FIG. 4A the first handle 32 is shown in an extended position away from the pulley housing 50 and the second handle 34 is shown in a retracted position adjacent the pulley housing 50. As shown in FIG. 4B, upon movement of the second handle 34 away from the pulley housing 50, the portion of the pulley rope 30 attached to the second handle 34 unwinds from the center pulley wheel 52, thereby causing an equal portion of the pulley rope 30 attached to the first handle 32 to be wound around the center pulley wheel 52. Then, upon movement of the second handle 34 away from the center pulley wheel 52, the portion of the pulley rope 30 attached to the second handle 34 unwinds from the center pulley wheel 52, thereby causing an equal portion of the pulley rope 30 attached to the first handle 34 to be wound around the center pulley wheel 52. The reciprocal handle motion is then repeated. The degree of resistance the person experiences in moving the handles 32 and 34 depends on the self-generated resistive force the person exerts on the opposite handle and also on the tension setting of the tension knob 56. During this exercise the pulley rope 30 rides over the guide pulleys 54 as the first and second handles 32 and 34 are reciprocated between the extended and retracted positions.

Figures 4C, 4D:
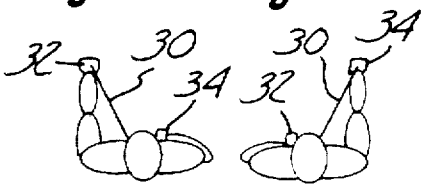
Figure 4E:
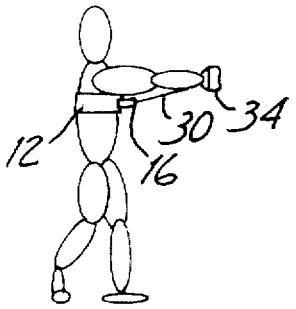

In FIGS. 4C–4E the belt member 12 is positioned under the persons arms. However, the handles 32 and 34 are now alternately pulled from the center of the person's body to a position where the person's arms are extended in front of the person's body and substantially perpendicular to the length of the body. This motion simulates a "punching" motion.

Figures 4H, 4I:
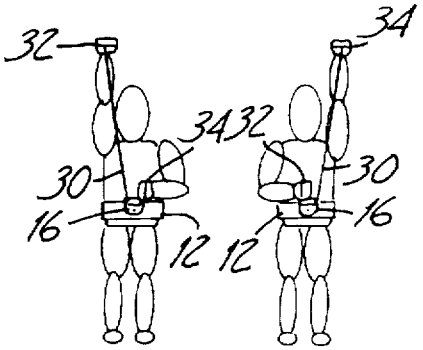
Figures 4F, 4G:
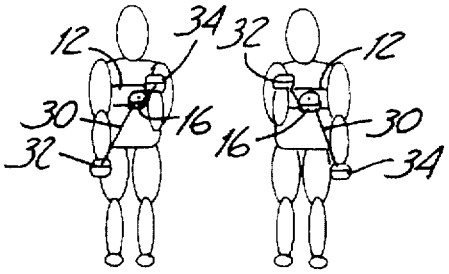

In FIGS. 4F–4G, the belt member 12 is positioned under the persons arms. However the handles 32 and 34 are now alternately pulled from the center of the person's body to a position where the person's arms are extended in front of the person's body and at an angle which is substantially less than perpendicular to the length of the body. This exercise simulates an arm "curling" exercise.

In FIGS. 4H–4I, the belt member 12 is positioned around the person's waist. The handles 32 and 34 are now alternately pulled upward from the center of the person's body to a position where the person's arms are extended in front of the person's body, preferably above the head. The arms may also be pulled upward and to the side of the person's body (not shown) with the belt being around the waist.

In all of the exercises shown in FIGS. 4A–4I, the workings of the components of the exercise apparatus 10 are the same (as described above with respect to FIGS. 4A–4B). The positioning of the belt member 12 and the direction of the arm movement may be varied any number of ways to provide a complete working of all of the upper body muscles. While use of the exercise apparatus 10 during an aerobic activity such as walking provides an increased aerobic effect, as well as muscle strengthening and toning, the exercise apparatus 10 may also be used in the absence of such an additional aerobic activity.

Although the present invention has been described with reference to preferred embodiments, workers skilled in the art will recognize that changes may be made in form and detail without departing from the spirit and scope of the invention.

What is claimed is:

1. An exercise apparatus comprising:

a belt member having a first end and second end, and a body section disposed between the first and second ends being, the first and second ends being securable to each other for fastening the belt member around the torso of a person;

a pulley housing mounted to the body section of the belt so that when the belt member is positioned on the person's torso the pulley housing is centered on the person's torso between the person's arms;

a center pulley wheel rotatably mounted within the pulley housing;

a pivot hinge attached to the body section of the belt and the pulley housing for pivotally mounting the pulley housing to the belt member such that the pulley housing pivots with respect to the belt member as the first and second handles are alternatively moved away from the center pulley wheel;

an adjustable tension mechanism attached to the pulley housing and the center pulley wheel for selectively adjusting an amount of force needed to rotate the center pulley wheel within the pulley housing; and a pulley cable having a first handle attached to a first end thereof and a second handle attached to a second end thereof, the pulley cable being wound around the center pulley wheel such that movement of the first handle in a direction away from the center pulley wheel and away from the person's torso moves the second handle toward the center pulley wheel, and such that movement of the second handle in a direction away from the center pulley wheel and away from the person's torso moves the first handle toward the center pulley wheel.

2. The exercise apparatus of claim 1, wherein the pulley housing pivots only in an upward and downward motion with respect to the belt member as the first and second handles are alternately moved away from the center pulley wheel.

3. The exercise apparatus of claim 1, further comprising a first guide pulley wheel and a second guide pulley wheel, the first guide pulley wheel being rotatably mounted within the pulley housing so that a first portion of the pulley cable runs between and engages both the center pulley wheel and the first guide wheel, the second guide pulley wheel being rotatably mounted within the pulley housing opposite the first guide wheel so that a second portion of the pulley cable runs between and engages both the center pulley wheel and the second guide wheel.

4. The exercise apparatus of claim 1, wherein the first and second handles each includes an adjustment mechanism for adjusting the position of the first and second handles, respectively, along the length of the pulley cable.

5. A method of exercising comprising the steps of:

providing an exercise apparatus which includes a belt member, a pivot hinge, a pulley housing pivotally mounted to the belt member via the pivot hinge such that the pulley housing pivots with respect to the belt member, a center pulley wheel rotatably mounted within the pulley housing, an adjustable tension mechanism attached to the pulley housing and the center pulley wheel for selectively adjusting an amount of tension between the center pulley wheel and the pulley housing, and a pulley cable arranged on the center pulley wheel;

attaching the belt member around the torso of a person so that the pulley housing is centered on the person's torso between the person's arms;

securing a first end of the pulley cable with one's hand and a second end of the pulley cable with one's other hand;

under self-generated, tensioned force between the first and second ends of the pulley cable, moving the first end of the pulley cable in a direction away from the pulley wheel and away from the person's torso such that the second end of the pulley cable is caused to move toward the pulley wheel; and subsequently and under self-generated, tensioned force between the first and second ends of the pulley cable, moving the second end of the pulley cable in a direction away from the center pulley wheel and the person's torso such that the first end is caused to move toward the center pulley.

6. The method of claim 5, wherein the belt member is attached around the waist of the person.

7. The method of claim 5, wherein the belt member is attached under the arms of the person.

8. The method of claim 5, wherein the pulley housing pivots only in an upward and downward motion with respect to the belt member.

9. The method of claim 5, wherein the belt member further comprises a first guide pulley wheel and a second guide pulley wheel, the first guide pulley wheel being rotatably mounted within the pulley housing so that a first portion of the pulley cable runs between and engages both the center pulley wheel and the first guide wheel, the second guide pulley wheel being rotatably mounted within the pulley housing opposite the first guide wheel so that a second portion of the pulley cable runs between and engages both the center pulley wheel and the second guide wheel.

10. The method of claim 5, wherein the belt member further includes a first handle attached to the first end of the pulley cabel and a second handle attached to the second end of the pulley cabel, each handle including an adjustament mechanism for adjusting the position of the first and second handles, respectively, along a length of the pulley cable, the method including the step of adjusting the the position of the first and second handles along the length of the pulley cabel.

* * * * *